US007607811B2

(12) United States Patent
Okada

(10) Patent No.: US 7,607,811 B2
(45) Date of Patent: Oct. 27, 2009

(54) LIGHTING UNIT

(75) Inventor: Noriko Okada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 110 days.

(21) Appl. No.: 11/937,903

(22) Filed: Nov. 9, 2007

(65) Prior Publication Data

US 2008/0112180 A1 May 15, 2008

(30) Foreign Application Priority Data

Nov. 9, 2006 (JP) ..... 2006-304306

(51) Int. Cl.
*F21V 7/00* (2006.01)

(52) U.S. Cl. ..... 362/545; 362/539; 362/538; 362/543

(58) Field of Classification Search ..... 362/800, 362/540–545
See application file for complete search history.

(56) References Cited

U.S. PATENT DOCUMENTS 7,364,332 B2 * 4/2008 Komatsu et al. ..... 362/522
7,410,958 B2 * 8/2008 Krasutsky et al. ..... 514/169
7,484,864 B2 * 2/2009 Okada ..... 362/300
7,500,773 B2 * 3/2009 Komatsu ..... 362/545

FOREIGN PATENT DOCUMENTS

| | | | |
|---|---|---|---|
| JP | 63111704 A | * | 5/1988 |
| JP | 63-111704 | * | 7/1988 |
| JP | 2005-108554 | * | 4/2005 |
| JP | 2005108554 A | * | 4/2005 |
| JP | 2006-164735 | * | 6/2006 |
| JP | 2006164735 A | * | 6/2006 |

* cited by examiner

*Primary Examiner*—Anabel M Ton
(74) *Attorney, Agent, or Firm*—Sughrue Mion, PLLC

(57) ABSTRACT

A lighting unit is provided with a cutoff line forming member disposed between a projection lens and a first light source and having a tip edge positioned in a vicinity of a rear focal point of the projection lens. The cutoff line forming member is capable of shielding a part of a light reflected by a reflector, thereby forming a cutoff line of a light distribution pattern for a low beam. An additional reflector is capable of collecting a light emitted from a second light source in a vicinity of the rear focal point of the projection lens. The light emitted from the second light source is collected in the vicinity of the rear focal point of the projection lens in a state in which the tip edge of the cutoff line forming member and the rear focal point of the projection lens are relatively separated from each other, and a light distribution pattern for a high beam is thus formed.

7 Claims, 8 Drawing Sheets

LIGHTING UNIT

This application claims foreign priority from Japanese Patent Application No. 2006-304306 filed on Nov. 9, 2006, the entire contents of which are hereby incorporated by reference.

BACKGROUND OF THE INVENTION

1. Field of the Invention

The present invention relates to a lighting unit for a vehicle in which a light distribution pattern for a low beam (lower beam) and a light distribution pattern for a high beam (upper beam) can be switched freely.

2. Related Art

Conventionally, some vehicle lighting devices such as headlamps have a structure in which a light distribution pattern for a low beam and a light distribution pattern for a high beam can be switched freely. For example, there has been known a vehicle lighting device of a four-lamp type in which low and high beams are constituted by an LED and a bulb, respectively.

In the vehicle lighting device of the multi-lamp type, however, it is hard to considerably reduce a size of the lighting device.

In a lighting device of a projector type which is provided with a projection lens disposed on an optical axis extended in a longitudinal direction of the vehicle and a reflector disposed behind the projection lens, particularly, a plurality of projection lenses and reflectors are provided side by side.

For this reason, a size of a whole lighting device is enlarged.

In order to reduce the size, JP-U-63-111704 discloses a headlamp of a projector type in which a light source bulb is disposed in a vicinity of a first focal point of a reflecting mirror (reflector). A light emitted from the light source bulb is reflected by the reflecting mirror. A second focal point of the reflecting mirror is positioned in a vicinity of a member having a cut line (a cutoff line forming member).

The reflected light is irradiated forward by a convex lens.

In the head lamp, a plane mirror is provided in the cutoff line forming member to increase a quantity of a light and is tilted to switch into a high beam.

Moreover, in a lighting device disclosed in JP-A-2006-164735 or JP-A-2005-108554, an additional light source for a high beam is provided. In the lighting device, there is provided a lighting unit of a projector type having two types of light distributing functions by a projection lens disposed on an optical axis extended in a longitudinal direction of the vehicle and first and second light source units disposed behind the projection lens. A light distribution pattern for a low beam having a clear cutoff line on an upper end of the light distribution pattern is formed by turning on the first light source unit, and an additional light distribution pattern for a high beam which is expanded upward from the cutoff line is added to form a light distribution pattern for a high beam by additionally turning on the second light source unit.

However, in the headlamp of a projector type disclosed in JP-U-63-111704, a bulb is used as a light source. Therefore, it is necessary to maintain a size in the reflector to some degree and it is hard to reduce a size of the lighting device.

Moreover, when the cutoff line forming member provided on the plane mirror is tilted to form a light distribution pattern for a high beam, it is impossible to increase a quantity of a light by the plane mirror. Consequently, a maximum quantity of the light is decreased so that a performance of the high beam cannot be satisfied. In the case in which an LED is used for a light source in order to reduce the size of the lighting device, an insufficient quantity of the light in the high beam becomes more remarkable.

On the other hand, the headlamp disclosed in JP-A-2006-164735 or JP-A-2005-108554, it is possible to reduce a size by using the LED as the light source and to increase the quantity of a light to some degree by additionally turning on the second light source unit. However, a tip of a shade for a low beam is fixed on a rear focal point of a lens. For this reason, a part of a beam irradiated by additionally turning on the second light source unit (the additional light source) generates an eclipse by the tip of the shade, and a center of the light distribution pattern for a high beam does not completely overlap with the light distribution pattern for a low beam.

In the light distribution pattern for a high beam, therefore, it is impossible to form a strong light collecting pattern in an overlap with the light distribution pattern for a low beam without an incompatibility (a dark portion generated by the eclipse). In order to effectively utilize the beam of the second light source unit, moreover, it is necessary to cause the additional light source to collect a light in the vicinity of the rear focal point. With the structure, however, alight generating the eclipse by the tip of the shade is increased so that a loss is increased.

SUMMARY OF THE INVENTION

One or more embodiments of the invention provide a lighting unit for a vehicle which can switch a light distribution pattern for a low beam and a light distribution pattern for a high beam by means of one projection lens and can form a strong light collecting pattern in an overlap with the low beam without an incompatibility in the high beam.

In accordance with one or more embodiments of the invention, a lighting unit for a vehicle is provided with: a projection lens disposed on an optical axis extended in a longitudinal direction of the vehicle; a first light source disposed behind a rear focal point of the projection lens; a second light source; a reflector configured to forward reflect a direct light emitted from the first light source close to the optical axis; a cutoff line forming member disposed between the projection lens and the first light source; and a light collecting portion configured to collect a light emitted from the second light source in a vicinity of the rear focal point of the projection lens. In the lighting unit, a relative position of a tip edge of the cutoff line forming member and the rear focal point is changeable between a first position and a second position, the tip edge is positioned in a vicinity of the rear focal point in the first position, and the tip edge of the cutoff line forming member is apart from the rear focal point in the second position. In the first position, the cutoff line forming member shields a part of a light reflected by the reflector which passes through a lower part of the rear focal point to form a cutoff line of a light distribution pattern for a low beam. In the second position, the light emitted from the second light source is collected in the vicinity of the rear focal point to form a light distribution pattern for a high beam.

According to the lighting unit having the above structure, when the tip edge of the cutoff line forming member is positioned on the rear focal point of the projection lens, a part of a beam emitted from the first light source which passes through a lower part of the rear focal point is intercepted by the tip edge so that a light distribution pattern for a low beam is formed.

On the other hand, in a state in which the rear focal point of the projection lens is relatively separated from the tip edge of the cutoff line forming member, the light emitted from the second light source is collected in the vicinity of the rear focal point of the projection lens.

More specifically, the light from the second light source which has conventionally been intercepted by the tip edge of the cutoff line forming member disposed on the rear focal point of the projection lens passes through the rear focal point by relatively separating the tip edge of the cutoff line forming member from the rear focal point. Consequently, a light (a high beam) from the second light source which does not generate an eclipse through the tip edge of the cutoff line forming member is caused to overlap with a light (a low beam) emitted from the first light source.

In the lighting unit having the above structure, a reflecting surface provided on an upper surface of the cutoff line forming member may reflect the light emitted from the second light source toward the projection lens in a state in which the tip edge is moved to a position placed apart from the rear focal point of the projection lens.

According to the lighting unit for a vehicle having the structure, when the tip edge of the cutoff line forming member is positioned on the rear focal point of the projection lens, a part of a light beam emitted from the first light source which passes through the lower part of the rear focal point is intercepted by the tip edge so that a light distribution pattern for a low beam is formed. At this time, a reflected light from the reflector which is to be originally intercepted by the upper surface of the cutoff line forming member is reflected by a reflecting surface provided on the upper surface and is incident on the projection lens. The reflected light is subjected to a conversion control into a low beam emitted downward from the projection lens so that a beam utilization ratio of the light emitted from the first light source can be increased.

On the other hand, when the tip edge of the cutoff line forming member is moved to the position placed apart from the rear focal point of the projection lens, the reflecting surface provided on the upper surface of the cutoff line forming member reflects the light emitted from the second light source toward the projection lens. Consequently, the tip edge of the cutoff line forming member is separated from the rear focal point, and at the same time, the light emitted from the second light source can be collected in the vicinity of the rear focal point of the projection lens by the reflecting surface of the cutoff line forming member in the separating position.

In the lighting unit having the above structure, moreover, the reflecting surface of the cutoff line forming member may be formed by a plane, and the light collecting portion for collecting the light emitted from the second light source may have a reflecting surface having a substantially elliptical sphere shape with focal points on a predetermined point in a symmetrical position with the rear focal point of the projection lens with respect to the plane interposed in a state in which the tip edge is moved to the position placed apart from the rear focal point of the projection lens, and on the second light source.

According to the lighting unit having the above structure, when the tip edge of the cutoff line forming member is positioned on the rear focal point of the projection lens, a part of the beam emitted from the first light source which passes through the lower part of the rear focal point is intercepted by the tip edge so that a light distribution pattern for a low beam is formed.

At this time, the reflected light from the reflector which is originally intercepted by the upper surface of the cutoff line forming member is reflected by the reflecting surface provided on the upper surface and is incident on the projection lens. The reflected light is subjected to a conversion control into a low beam emitted downward from the projection lens so that a beam utilization ratio of the light emitted from the first light source can be increased.

On the other hand, when the tip edge of the cutoff line forming member is moved to the position placed apart from the rear focal point of the projection lens, the light which is emitted from the second light source and is collected by the reflecting surface (a light collecting portion) having a substantially elliptical sphere shape for collecting the light emitted from the second light source is collected into a predetermined point in the symmetrical position with the rear focal point of the projection lens with respect to the plane of the cutoff ling forming member interposed therebetween. More specifically, the light emitted from the second light source is collected into the rear focal point of the projection lens by the reflecting surface provided on the plane and is then incident on the projection lens. Consequently, the tip edge of the cutoff line forming member is separated from the rear focal point, and at the same time, the light emitted from the second light source can be collected in the vicinity of the rear focal point of the projection lens by the reflecting surface of the cutoff line forming member in the separating position.

In the lighting unit having the above structure, moreover, the plane of the cutoff line forming member may have a step extended in the longitudinal direction of the vehicle in order to form the cutoff line, and the light collecting portion may have a pair of reflecting surfaces each having a substantially elliptical sphere shape in which a focal length is varied corresponding to the step.

That is, the reflecting surface of the cutoff forming member may be provided with a first plane and a second plane, a step extending in the longitudinal direction of the vehicle may be formed between the first plane and the second plane, and the cutoff line is formed by the step, the light collecting portion may be provided with a first reflecting surface and a second reflecting surface, the first reflecting surface may be formed in a substantially elliptical sphere shape having focal points on a point in a symmetrical position with the rear focal point with respect to the first plane in the second position and on the second light source, and the second reflecting surface may be formed in a substantially elliptical sphere shape having focal points on a point in a symmetrical position with the rear focal point with respect to the second plane in the second position and on the second light source.

According to the lighting unit having the above structure, in the case in which the upper surface is continuously formed in the shape of the tip edge forming the cutoff line so that the step is formed on the upper surface in the cutoff line forming member in respect of the easiness of manufacture, the light collecting portion is formed by a pair of reflecting surfaces each having a substantially elliptical sphere shape having a focal length varied corresponding to the step. Consequently, a reflected light path distance from one of the reflecting surfaces having a substantially elliptical sphere shape to the reflecting surface in a lower stage of the cutoff line forming member is equal to a reflected light path distance from the other reflecting surface taking the shape of a substantially elliptical sphere to the reflecting surface in an upper stage. Thus, it is possible to form a light collecting pattern having a greater light collection by using the cutoff line forming member which can easily be manufactured.

In the lighting unit for a vehicle having the structure, furthermore, the reflecting surface of the cutoff line forming member may be formed in a substantially elliptical sphere shape having focal points on the rear focal point of the projection lens and on the second light source.

According to the lighting unit having the above structure, when the tip edge of the cutoff line forming member is moved to the position placed apart from the rear focal point of the projection lens, the light emitted from the second light source is reflected by the reflecting surface having the substantially elliptical sphere shape of the cutoff line forming member, and the light is collected into the focal point of the projection lens and is then incident on the projection lens.

Consequently, the tip edge of the cutoff line forming member is separated from the rear focal point, and at the same time, the light emitted from the second light source can be collected in the vicinity of the rear focal point of the projection lens by the reflecting surface of the cutoff line forming member in the separating position. Therefore, the light emitted from the second light source can be collected into the rear focal point of the projection lens by means of one optical element (the reflecting surface taking the shape of a substantially elliptical sphere) and can be then incident on the projection lens. For this reason, it is not necessary to provide other optical elements (a plane mirror and a lens) together. Consequently, it is possible to lessen a strength loss due to a reflection and a light absorption with respect to the light emitted from the second light source.

In the lighting unit having the above structure, moreover, the light collecting portion for collecting a light from the second light source may have a reflecting surface having a substantially elliptical sphere shape with focal points on the rear focal point of the projection lens in a state in which the projection lens is moved to the position placed apart from the tip edge of the cutoff line forming member along the optical axis extended in the longitudinal direction of the vehicle and on the second light source.

According to the lighting unit having the above structure, when the tip edge of the cutoff line forming member is positioned on the rear focal point of the projection lens, a part of a beam emitted from the first light source which passes through the lower part of the rear focal point is intercepted by the tip edge so that a light distribution pattern for a low beam is formed.

On the other hand, when the projection lens is moved along the optical axis extended in the longitudinal direction of the vehicle, the rear focal point of the projection lens is moved to the position placed apart from the tip edge of the cutoff line forming member. In this state, the light emitted from the second light source is reflected by the reflecting surface having a substantially elliptical sphere shape in the light collecting portion. Consequently, the light is collected into the rear focal point of the projection lens which is moved.

Consequently, a high beam which does not generate an eclipse by the tip edge of the cutoff line forming member is caused to overlap with a low beam.

In the lighting unit having the above structure, furthermore, the tip edge of the cutoff line forming member may freely move to a position placed apart from the projection lens along the optical axis extended in the longitudinal direction of the vehicle.

According to the lighting unit having the above structure, when the tip edge of the cutoff line forming member is positioned on the rear focal point of the projection lens, a part of a beam emitted from the first light source which passes through the lower part of the rear focal point is intercepted by the tip edge so that a light distribution pattern for a low beam is formed.

On the other hand, in a state in which the tip edge of the cutoff line forming member is moved to the position placed apart from the rear focal point of the projection lens, the light emitted from the second light source is collected in the vicinity of the rear focal point of the projection lens.

Consequently, a high beam which does not generate an eclipse by the tip edge of the cutoff line forming member is caused to overlap with a low beam.

The lighting unit for a vehicle according to one or more embodiments of the invention is provided with a cutoff line forming member disposed between a projection lens and a first light source and serving to form a light distribution pattern for a low beam by shielding a part of a light reflected from a reflector, and a light collecting portion for collecting a light emitted from a second light source in the vicinity of a rear focal point of the projection lens, and forms a light distribution pattern for a high beam by collecting the light emitted from the second light source in the vicinity of the rear focal point of the projection lens in a state in which a tip edge of the cutoff line forming member and the rear focal point of the projection lens are relatively separated from each other.

Therefore, the light from the second light source which has conventionally been intercepted by the tip edge of the cutoff line forming member disposed on the rear focal point of the projection lens can pass through the rear focal point by relatively separating the tip edge from the rear focal point.

Consequently, the light distribution pattern for a low beam and the light distribution pattern for a high beam can be switched by means of a projection lens, and furthermore, it is possible to form a strong light collecting pattern in an overlap with the low beam without an incompatibility in the high beam.

Other aspects and advantages of the invention will be apparent from the following description and the appended claims.

DETAILED DESCRIPTION OF THE EXEMPLARY EMBODIMENTS

A lighting unit for a vehicle according to exemplary embodiments of the invention will be described below in detail with reference to the accompanying drawings.

Figure 1:
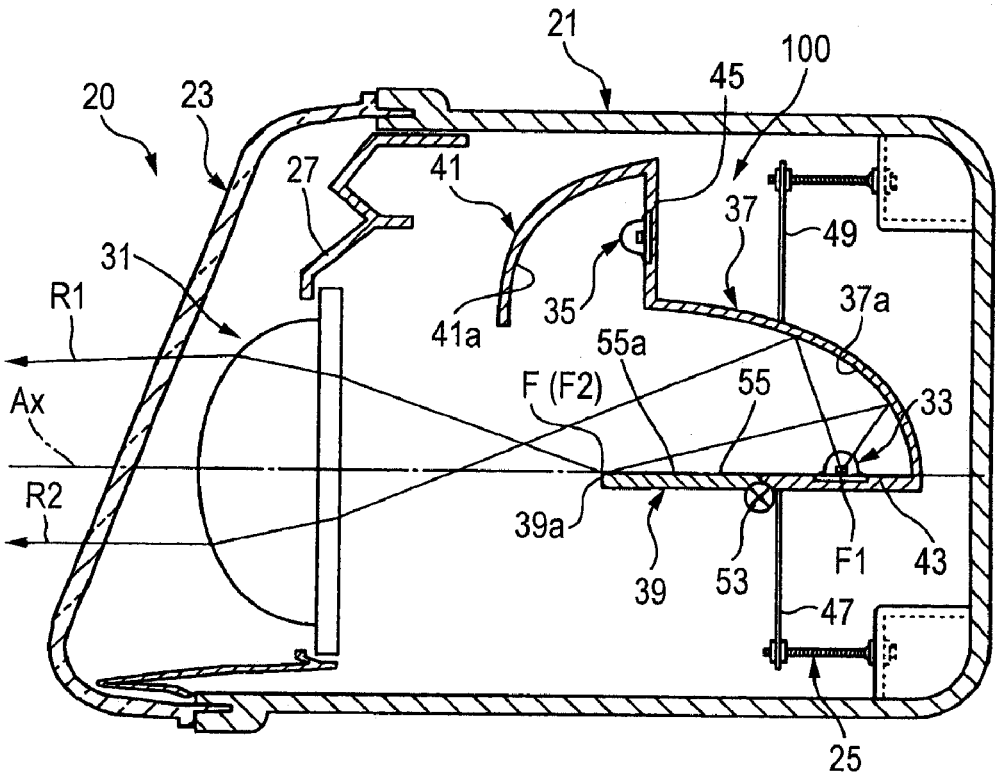
FIG. 1 is a longitudinal sectional view showing a lighting device for a vehicle provided with a lighting unit for a vehicle according to a first exemplary embodiment of the invention.
Figure 2:
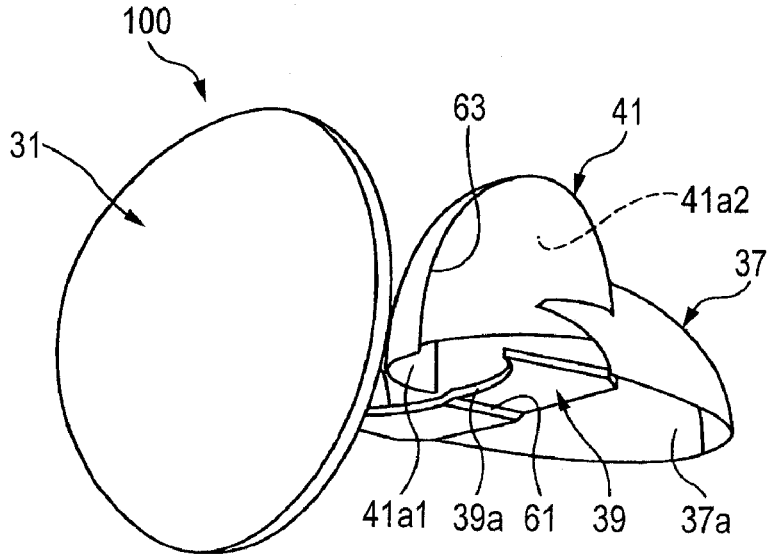
FIG. 2 is a perspective view showing an irradiation of a low beam in the lighting unit for a vehicle illustrated in FIG. 1.
Figure 3:
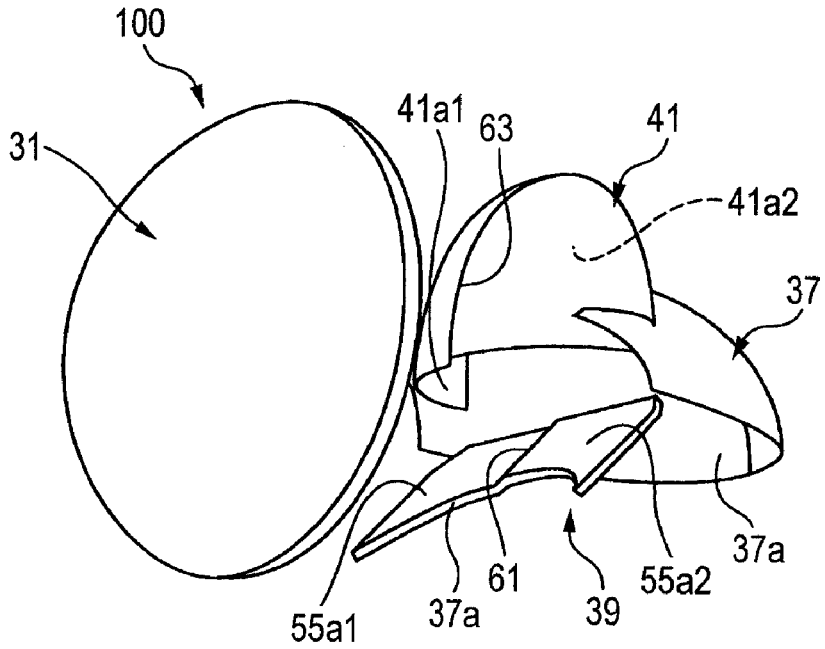
FIG. 3 is a perspective view showing an irradiation of a high beam in the lighting unit for a vehicle illustrated in FIG. 1.

FIG. 1 is a longitudinal sectional view showing a lighting unit for a vehicle provided with a lighting unit for a vehicle according to a first exemplary embodiment of the invention, FIG. 2 is a perspective view showing an irradiation of a low beam in the lighting unit for a vehicle illustrated in FIG. 1, and FIG. 3 is a perspective view showing an irradiation of a high beam in the lighting unit for a vehicle illustrated in FIG. 1.

A lighting device 20 according to the first exemplary embodiment is provided with a lamp body 21 formed by a synthetic resin and taking a shape of a container having a front surface side opened, a transparent front cover 23 assembled onto the front opening portion of the lamp body 21 and serving to partition and form a lamp housing S together with the lamp body 21, and a lighting unit 100 accommodated in the lamp housing S and supported to freely regulate a tilt in vertical and transverse directions by means of aiming mechanisms 25 and 25.

The lighting device 20 can regulate an irradiating angle of the lighting unit 100. Therefore, a clearance is present between the lamp body 21 and the lighting unit 100. An extension 27 is provided for preventing the clearance from being visually recognized from an outside.

The lighting unit 100 is provided with a projection lens 31 disposed on an optical axis Ax extended in a longitudinal direction of the vehicle, LEDs (light emitting diodes) 33 and 35 to be a first light source disposed behind the projection lens 31 and a second light source, a reflector 37 disposed behind a rear focal point F of the projection lens 31 and serving to forward reflect a direct light emitted from the LED 33 close to the optical axis Ax, a cutoff line forming member 39 disposed between the projection lens 31 and the LED 33 and having a tip edge 39*a* positioned in the vicinity of the rear focal point F of the projection lens 31 to shield a part of a light reflected from the reflector 37, thereby forming a cutoff line having a light distribution pattern for a low beam, and an additional reflector 41 to be a light collecting portion for collecting a light emitted from the LED 35 in the vicinity of the rear focal point F of the projection lens 31.

A plano-convex lens having a forward side surface to be a convex curved surface and a rear side surface to be a plane is generally used for the projection lens 31. In the projection lens 31, a line connecting upper and lower ends of a rear end face to be a plane opposed to the reflector 37 is disposed in parallel with a vertical line.

The LEDs 33 and 35 are white light emitting diodes including a single light emitting chip having a size of approximately 1 mm square or a rectangular light emitting portion in which a plurality of chips is arranged, for example, and are fixed to respective base portions 43 and 45 in a state in which they are mounted on a substrate. The reflector 37, the additional reflector 41 and the base portions 43 and 45 are formed integrally and can be supported on the aiming mechanism 25 through brackets 47 and 49.

The reflector 37 has a reflecting surface 37*a* having a substantially elliptical sphere shape setting the optical axis Ax to be a central axis thereof. The reflecting surface 37*a* is formed to have a substantially elliptical section including the optical axis Ax, and an eccentricity thereof is set to be gradually increased from a vertical section toward a horizontal section.

The LED 33 is disposed on a first focal point F1 of an ellipse formed by the vertical section including the optical axis Ax of the reflecting surface 37*a*. Consequently, the reflecting surface 37*a* serves to forward reflect the light emitted from the LED 33 close to the optical axis Ax. In that case, in the vertical section including the optical axis Ax, the light is substantially converged on a second focal point F2 of the ellipse. In the first exemplary embodiment, the second focal point F2 is substantially coincident with the rear focal point F of the projection lens 31.

The cutoff line forming member 39 is a shielding member for shielding a part of a light emitted from the LED 33 and reflected by the reflecting surface 37*a* of the reflector 37.

The tip edge 39*a* of the cutoff line forming member 39 is disposed in such a manner that a longitudinal direction of the tip edge 39*a* is orthogonal to the optical axis Ax slightly behind the second focal point F2 of the reflector 37 in the longitudinal direction of the vehicle. In the cutoff line forming member 39, the tip edge 39*a* has a shape corresponding to a shape of a light distribution pattern projected forward, and a light transmitted toward the second focal point F2 is partially shielded corresponding to the shape of the tip edge 39*a*.

Figure 4:
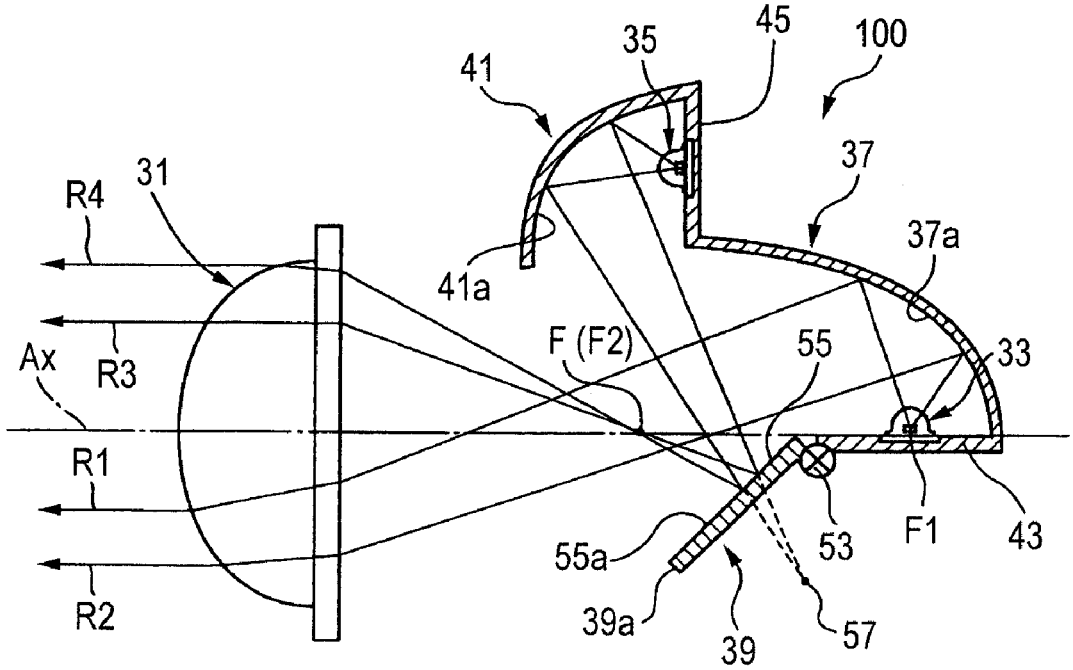
FIG. 4 is a longitudinal sectional view showing the lighting unit for a vehicle in the irradiation of the high beam illustrated in FIG. 3 together with an optical path, FIG. 5(*a*) is a perspective view showing a light distribution pattern for a low beam, and FIG. 5(*b*) is a perspective view showing a light distribution pattern for a high beam, which are formed on a virtual vertical screen disposed in a forward position of 25 mm from the lighting device by a light irradiation from the lighting unit for a vehicle illustrated in FIG. 1.
Figure 5:
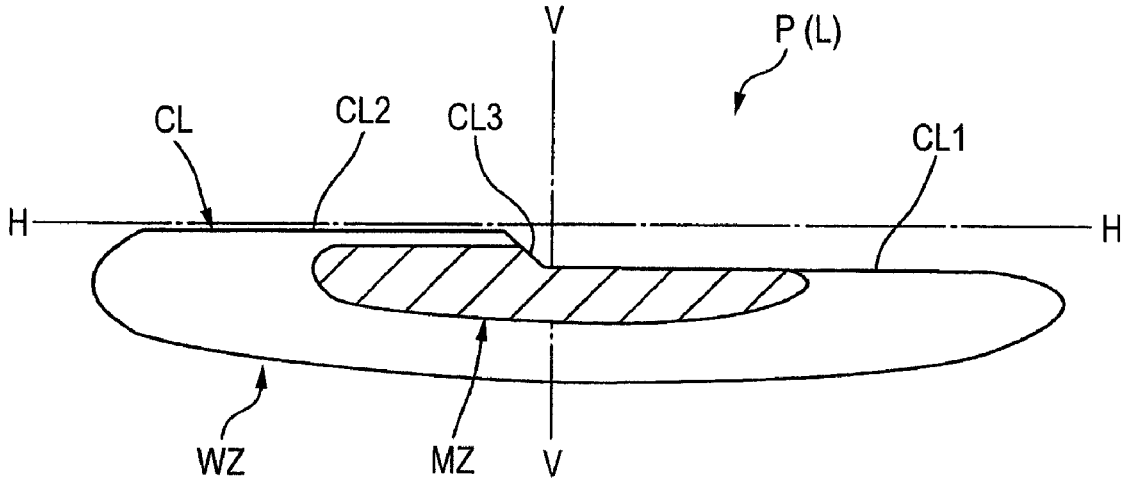
Figure 5:
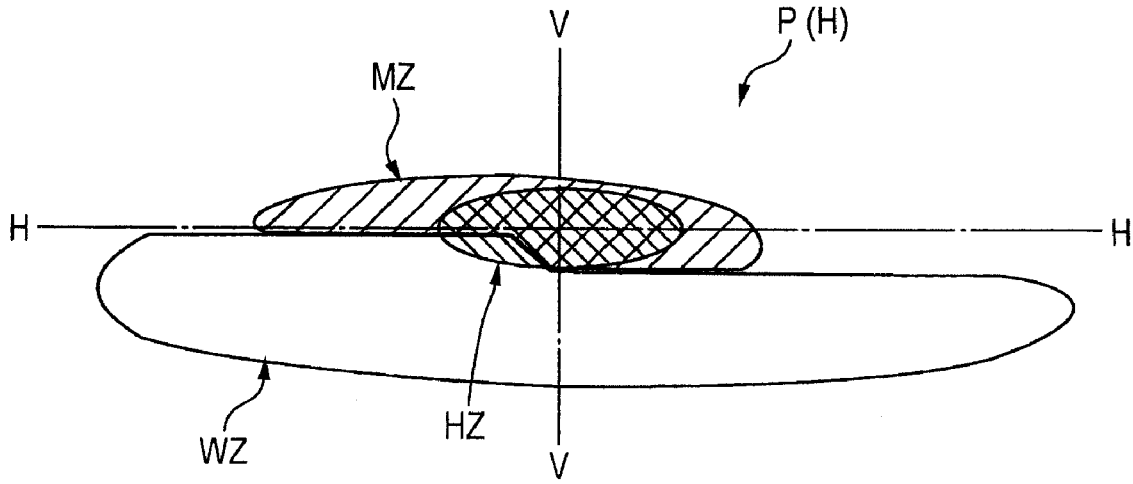

FIG. 4 is a longitudinal sectional view showing a lighting unit for a vehicle in an irradiation of a high beam illustrated in FIG. 3 together with an optical path, FIG. 5(*a*) is a perspective view showing a light distribution pattern for a low beam, and FIG. 5(*b*) is a perspective view showing a light distribution pattern for a high beam which are formed on a virtual vertical screen disposed in a forward position of 25 m of the lighting device through a light irradiation from the lighting unit for a vehicle illustrated in FIG. 1.

In the first exemplary embodiment, the cutoff line forming member 39 is supported on the base portion 43 through a rotating shaft 53 and can be thus rotated around the rotating shaft 53 between a low beam constituting position (a first position shown in FIGS. 1 and 2) and a high beam constituting position (a second position shown in FIGS. 3 and 4).

When the cutoff line forming member 39 is placed in the low beam constituting position (the first position) as shown in FIG. 1, it is disposed in such a manner that the tip edge 39*a* passes through the vicinity of the second focal point F2, shields a part of the light reflected from the reflecting surface 37*a*, removes an upward irradiation light emitted from the lighting unit 100 and obtains an irradiation light for a low beam which is irradiated downward with respect to the optical axis Ax.

Consequently, there is formed a low beam light distribution pattern P(L) for left passing which has a so-called Z type cutoff line CL on a double level at right and left sides shown in FIG. 5(*a*).

On the other hand, when the cutoff line forming member 39 is placed in the high beam constituting position (the second position) as shown in FIG. 4, it releases the shield of the light reflected from the reflecting surface 37*a* and also permits the emission of the upward irradiation light from the lighting unit 100, thereby obtaining an irradiation light for a high beam.

Consequently, there is formed a high beam light distribution pattern P(H) shown in FIG. 5(*b*).

A reflecting surface 55*a* is formed on an upper surface 55 of the cutoff line forming member 39 by a mirror finishing treatment. When the tip edge 39*a* of the cutoff line forming member 39 is positioned on the rear focal point F of the projection lens 31, a part of a beam emitted from the LED 33 is intercepted by the tip edge 39*a* as described above so that a light distribution pattern for a low beam is formed. At this time, the light which is reflected from the reflector 37 and is to be originally intercepted by the upper surface 55 of the cutoff line forming member 39 is reflected by the reflecting surface 55*a* provided on the upper surface 55 and is incident on the projection lens 31. The reflected light is subjected to a conversion control into a low beam to be emitted downward from the projection lens 31 so that a beam utilization ratio of the light emitted from the LED 33 is increased.

The LED 35 is turned on only in the formation of the light distribution pattern for a high beam. The light emitted from the LED 35 is irradiated on the reflecting surface 55*a* of the cutoff line forming member 39 by the additional reflector 41.

The additional reflector 41 has a reflecting surface 41*a* having a substantially elliptical sphere shape with focal points on a predetermined point 57 in a symmetrical position with the rear focal point F of the projection lens 31 with respect to a plane (the reflecting surface 55*a*) interposed in a state in which the tip edge 39*a* is moved to a position placed apart from the rear focal point F of the projection lens 31 (a state shown in FIG. 4) and on the LED 35.

When the tip edge 39*a* of the cutoff line forming member 39 is moved to the position placed apart from the rear focal point F of the projection lens 31, accordingly, the reflecting surface 55*a* provided on the upper surface 55 of the cutoff line forming member 39 reflects the light emitted from the LED 35 toward the projection lens 31.

Consequently, the tip edge 39*a* of the cutoff line forming member 39 is separated from the rear focal point F, and at the same time, the light emitted from the LED 35 can be collected in the vicinity of the rear focal point F of the projection lens 31 by the reflecting surface 55*a* of the cutoff line forming member 39 in the separating position without an eclipse.

More specifically, in the lighting unit 100, the light emitted from the LED 35 is collected in the vicinity of the rear focal point F of the projection lens 31 to form the light distribution pattern for a high beam in a state in which the tip edge 39*a* of the cutoff line forming member 39 and the rear focal point F of the projection lens 31 are relatively separated from each other.

The upper surface 55 of the cutoff line forming member 39 has a step 61 extended in the longitudinal direction of the vehicle in order to form a cutoff line as shown in FIGS. 2 and 3. In other words, the upper surface 55 is partitioned into a lower stage reflecting surface 55*a*1 and an upper stage reflecting surface 55*a*2 shown in FIG. 3 with the step 61 interposed therebetween. Consequently, the additional reflector 41 forms a pair of reflecting surfaces 41*a*1 and 41*a*2 (a first reflecting surface 41*a*1, a second reflecting surface 41*a*2) each formed in a substantially elliptical sphere shape and having different focal lengths corresponding to the step 61 with the step 61 set to be a boundary.

In the cutoff line forming member 39, thus, the upper surface 55 is continuously formed in the shape of the tip edge 39*a* forming a cutoff line in respect of a manufacturing easiness. As a result, in the case in which the step 61 is formed on the upper surface 55, the additional reflector 41 is formed by a pair of reflecting surfaces 41*a*1 and 41*a*2 taking a shape of a substantially elliptical sphere and having different focal lengths corresponding to the step 61. Consequently, a reflected light path distance from the reflecting surface 41*a*1 taking the shape of a substantially elliptical sphere to the lower stage reflecting surface 55*a*1 (a first reflecting surface 55*a*1) of the cutoff line forming member 39 and a reflected light path distance from the reflecting surface 41*a*2 taking the shape of a substantially elliptical shape to the upper stage reflecting surface 55*a*2 (a second reflecting surface 55*a*2) are equal to each other. Thus, it is possible to form a light collecting pattern having a greater light collection by using the cutoff line forming member 39 which can easily be manufactured.

In the case in which a shape for forming the cutoff line is provided in only the tip edge 39*a* and the step 61 is not continuously formed on the upper surface 55 of the cutoff line forming member 39, it is not necessary to provide the step 61 in the additional reflector 41.

Description will be given to the function of the lighting unit 100.

When the tip edge 39*a* of the cutoff line forming member 39 is positioned on the rear focal point F of the projection lens 31 as shown in FIG. 1, a part of the beam emitted from the LED 35 is intercepted by the tip edge 39*a* so that the low beam light distribution pattern P(L) having the cutoff line CL as shown in FIG. 5(*a*) is formed.

The cutoff line CL is a light distribution pattern for left passing which has a cutoff line CL1 on an opposing lane side and a cutoff line CL2 on a self-lane side which are horizontal with respect to an upper edge thereof, and an oblique cutoff line CL3.

A light R1 reflected by the reflecting surface 37*a* and incident on the projection lens 31 forms a diffusing zone WZ shown in FIG. 5. Moreover, a light R2 reflected by the reflecting surface 37*a*, reflected by the reflecting surface 55*a* of the upper surface 55 and incident on the projection lens 31 is subjected to a conversion control into a low beam to be emitted downward, thereby contributing to the formation of an intermediate zone MZ. Consequently, it is possible to increase a beam utilization ratio of the light emitted from the LED 33.

On the other hand, when the tip edge 39*a* of the cutoff line forming member 39 is moved to a position placed apart from the rear focal point F of the projection lens 31 as shown in FIG. 4, the beam emitted from the LED 35 is not intercepted but is incident on the projection lens 31 so that the high beam light distribution pattern P(H) shown in FIG. 5(*b*) is formed.

In this case, the cutoff line CL disappears. More specifically, in FIG. 4, the light R1 reflected by the reflecting surface 37*a* and incident on the projection lens 31 forms the diffusing zone WZ shown in FIG. 5(*b*). Moreover, the light R2 reflected by the reflecting surface 37*a* and incident on the projection lens 31 contributes to the formation of the intermediate zone MZ on an upper side of a horizontal line H-H.

Furthermore, the LED 35 is turned on so that lights R3 and R4 emitted from the LED 35 and collected by the reflecting surface 41*a* of the additional reflector 41 are collected toward the predetermined position 57 in a symmetrical position with the rear focal point F of the projection lens 31 with the reflecting surface 55*a* of the cutoff line forming member 39 interposed therebetween.

In other words, the lights R3 and R4 reflected by the reflecting surface 41*a* in the additional reflector 41 are reflected by the reflecting surface 55*a* of the cutoff line forming member 39 and are collected in the rear focal point F, and are then incident on the projection lens 31. The lights R3 and R4 contribute to the formation of a hot zone HZ shown in FIG. 5(*b*).

According to the lighting unit 100 according to the first exemplary embodiment, thus, a light from a second light source which has conventionally been intercepted by a tip edge of a cutoff line forming member disposed on a rear focal point of a projection lens can pass through the rear focal point F by relatively separating the tip edge 39*a* of the cutoff line forming member 39 from the rear focal point F. Consequently, a light for a high beam which does not generate an eclipse by the tip edge 39*a* of the cutoff line forming member 39 is caused to overlap with a light for a low beam.

According to the lighting unit 100 in accordance with the first exemplary embodiment, therefore, the low beam light distribution pattern P (L) and the high beam light distribution pattern P(H) can be switched by one projection lens 31. In the high beam light distribution pattern P(H), furthermore, it is possible to form a great light collecting pattern in which a high beam and a low beam overlap with each other without an incompatibility by additionally turning on the LED 35 with the LED 33 turned on.

While the description has been given to the case in which the reflecting surface 41*a* having a substantially elliptical sphere shape in the additional reflector 41 and the planar reflecting surface 55*a* of the cutoff line forming member 39 are used as the light collecting portion of the LED 35 in the first exemplary embodiment, the combination of the substantially elliptical sphere and the plane is not restricted but a pair of reflectors having a combination of a substantially paraboloid and a substantially paraboloid may be used for the light collecting portion according to the invention, for example.

Figure 6:
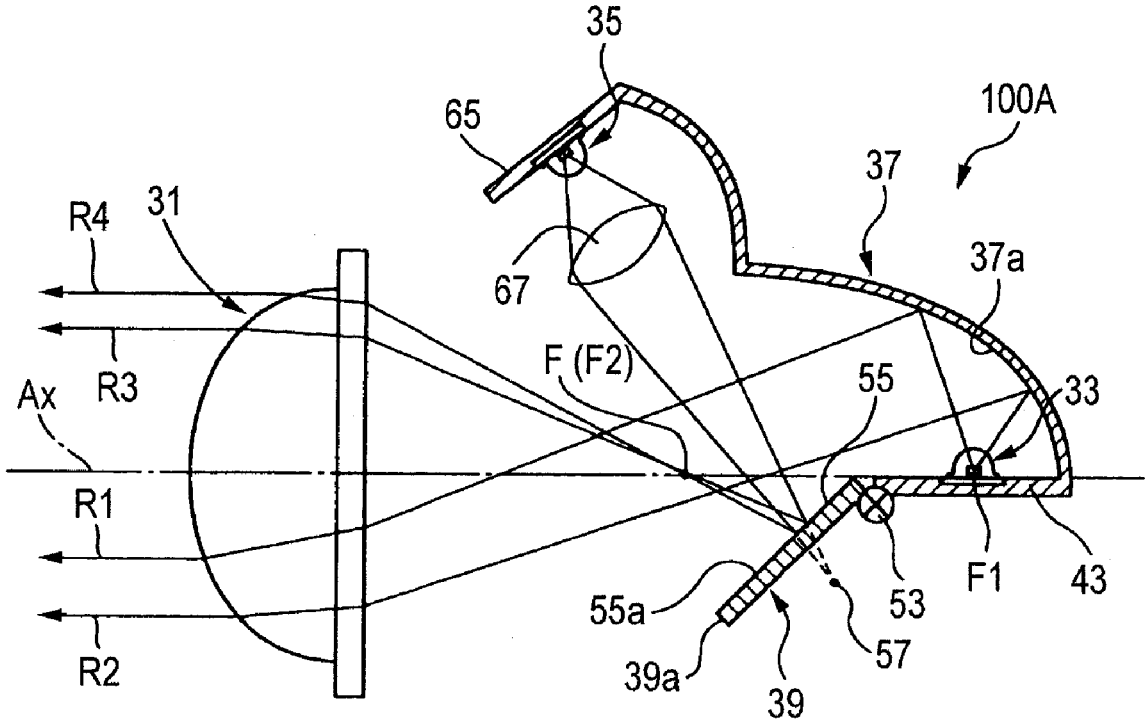
FIG. 6 is a longitudinal sectional view showing a modified example in which a convex lens is used as a light collecting portion of a second light source, FIG. 7(*a*) is a longitudinal sectional view showing a low beam irradiation, and FIG. 7(*b*) is a longitudinal sectional view showing a high beam irradiation, in the lighting unit for a vehicle according to a second exemplary embodiment of the invention in which a projection lens is movable, FIG. 8(*a*) is a perspective view showing a light distribution pattern for a low beam, and FIG. 8(*b*) is a perspective view showing a light distribution pattern for a high beam, which are formed on a virtual vertical screen disposed in a forward position of 25 mm from the lighting device by a light irradiation from the lighting unit for a vehicle illustrated in FIGS. 7(*a*) and 7(*b*), FIG. 9(*a*) is a longitudinal sectional view showing a low beam irradiation and FIG. 9(*b*) is a longitudinal sectional view showing a high beam irradiation, in the lighting unit for a vehicle according to a third exemplary embodiment of the invention in which a tip edge of a cutoff line forming member is movable.

As shown in a lighting unit 100A for a vehicle shown in FIG. 6, moreover, the LED 35 may be supported on a base portion 65 and a convex lens 67 may be used as the light collecting portion for collecting the light emitted from the LED 35 in the predetermined point 57.

Next, description will be given to a lighting unit for a vehicle according to a second exemplary embodiment of the invention. The same components as those in the lighting unit 100 according to the first exemplary embodiment shown in FIGS. 1 to 5(*b*) have the same reference numerals, and repetitive description will be omitted.

Figure 7:
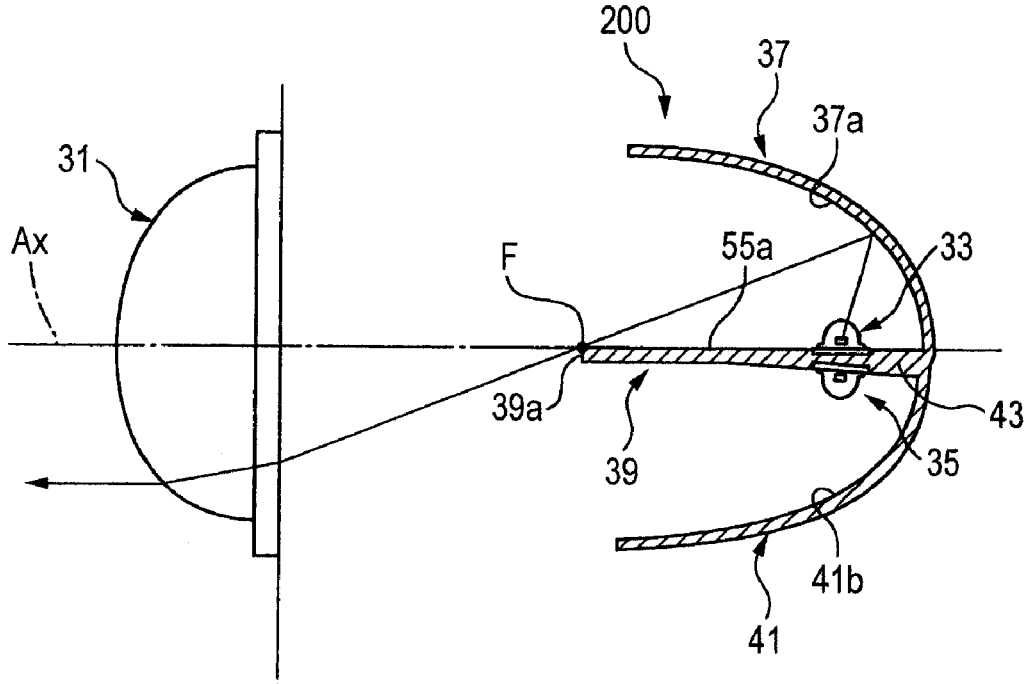
Figure 7:
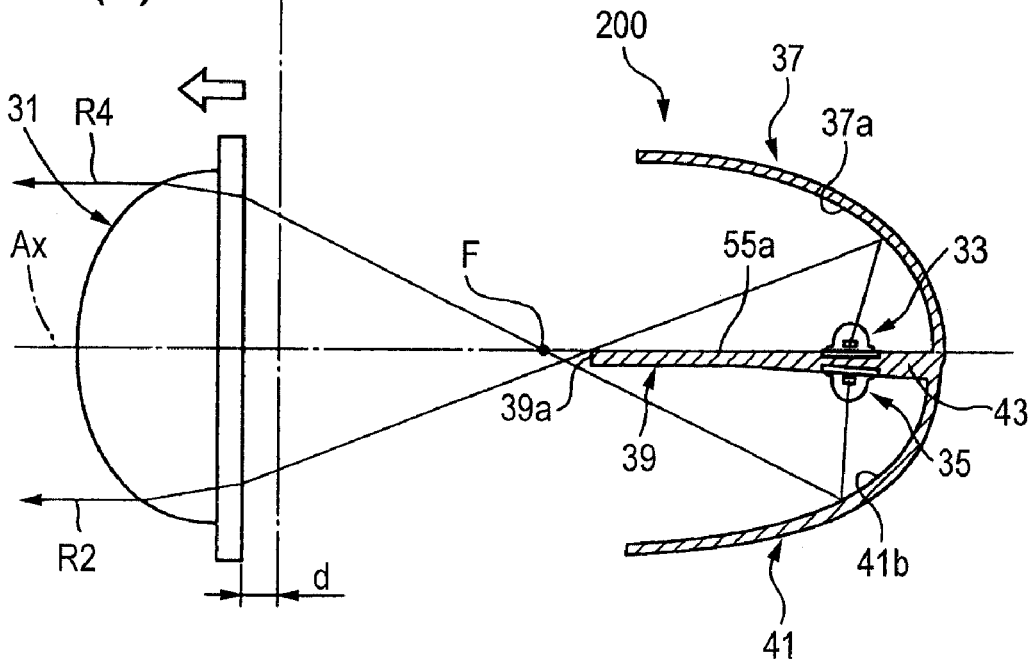
Figure 8:
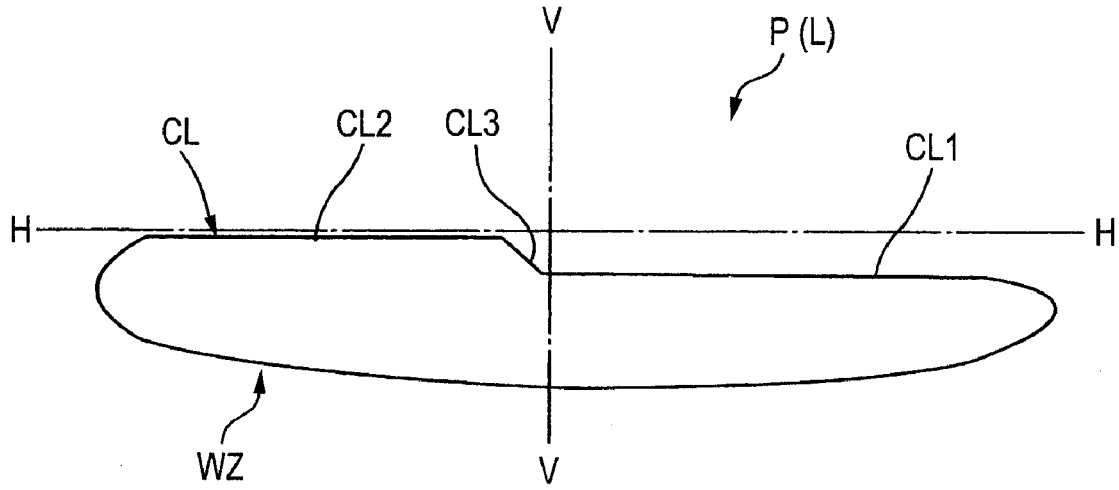
Figure 8:
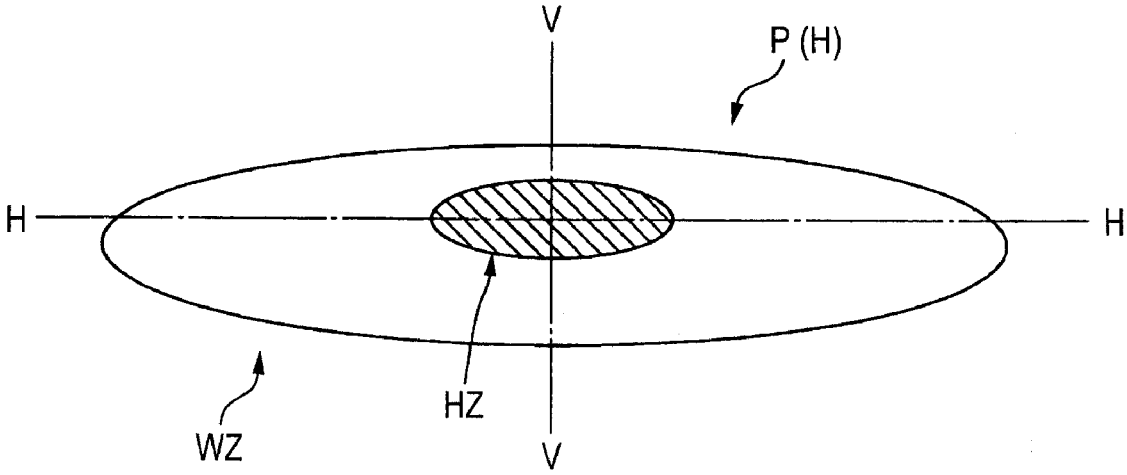

FIG. 7(*a*) is a longitudinal sectional view showing a low beam irradiation, and FIG. 7(*b*) is a longitudinal sectional view showing a high beam irradiation in the lighting unit for a vehicle according to the second exemplary embodiment of the invention in which a projection lens 31 is movable. FIG. 8(*a*) is a perspective view showing a light distribution pattern for a low beam, and FIG. 8(*b*) is a perspective view showing a light distribution pattern for a high beam, which are formed on a virtual vertical screen disposed in a forward position of 25 mm from the lighting device by a light irradiation from the lighting unit for a vehicle illustrated in FIGS. 7(*a*) and 7(*b*).

In a lighting unit 200 for a vehicle according to the second exemplary embodiment, an LED 35 to be a second light source is provided on a lower surface side of a base portion 43.

A cutoff line forming member 39 is extended toward a tip side of the base portion 43. The cutoff line forming member 39 is fixed integrally with the base portion 43.

An additional reflector 41 is disposed on an opposite side of a reflector 37 with the base portion 43 interposed therebetween. Moreover, the projection lens 31 is movable within a predetermined range of d in a direction along an optical axis Ax by means of an actuator which is not shown. The predetermined range d in which the projection lens 31 is movable is set to be such a distance that a diffusing zone WZ maintains a proper illuminance.

The additional reflector 41 has a reflecting surface 41*b* formed in a substantially elliptical sphere shape having focal points on a rear focal point F of the projection lens 31 in a state in which the projection lens 31 is moved to a position placed apart from a tip edge 39*a* of the cutoff line forming member 39 along the optical axis Ax extended in a longitudinal direction of the vehicle (a state in FIG. 7(*b*)) and on the LED 35.

According to the lighting unit 200 for a vehicle, therefore, when the tip edge 39*a* of the cutoff line forming member 39 is positioned on the rear focal point F of the projection lens 31 as shown in FIG. 7(*a*) (that is, in the first position), a part of a beam emitted from an LED 33 is intercepted by the tip edge 39*a* so that a low beam light distribution pattern P(L) shown in FIG. 8(*a*) is formed.

On the other hand, when the projection lens 31 is moved forward along the optical axis Ax extended in the longitudinal direction of the vehicle as shown in FIG. 7(*b*) (that is, in the second position), the rear focal point F of the projection lens 31 is moved to a position placed apart from the tip edge 39*a* of the cutoff line forming member 39. In this state, a light emitted from the LED 35 is reflected by the reflecting surface 41*b* taking the shape of a substantially elliptical sphere in the additional reflector 41 so that the light is collected in the rear focal point F of the projection lens 31 thus moved.

Consequently, the LED 35 is additionally turned on with the LED 33 turned on so that a high beam which does not generate an eclipse by the tip edge 39*a* of the cutoff line forming member 39 is caused to overlap with a low beam.

In the second exemplary embodiment, there is employed the structure in which the projection lens 31 is movable and the light emitted from the LED 35 is collected in the vicinity of the rear focal point F of the projection lens 31 in a state in which the tip edge 39*a* of the cutoff line forming member 39 and the rear focal point F of the projection lens 31 are relatively separated from each other.

On the other hand, it is also possible to employ a structure in which the projection lens 31 is fixed, the LEDs 33 and 35 fixed to the base portion 43, the cutoff line forming member 39, the reflector 37 and the additional reflector 41 are integrally movable, and the light emitted from the LED 35 is collected in the vicinity of the rear focal point F of the projection lens 31 in a state in which the tip edge 39*a* of the cutoff line forming member 39 and the rear focal point F of the projection lens 31 are relatively separated from each other.

Next, description will be given to a lighting unit 300 for a vehicle according to a third exemplary embodiment of the invention. The same components as those in the lighting unit 200 for a vehicle according to the second exemplary embodiment shown in FIGS. 7(*a*) and 7(*b*) have the same reference numerals, and repetitive description will be omitted.

Figure 9:
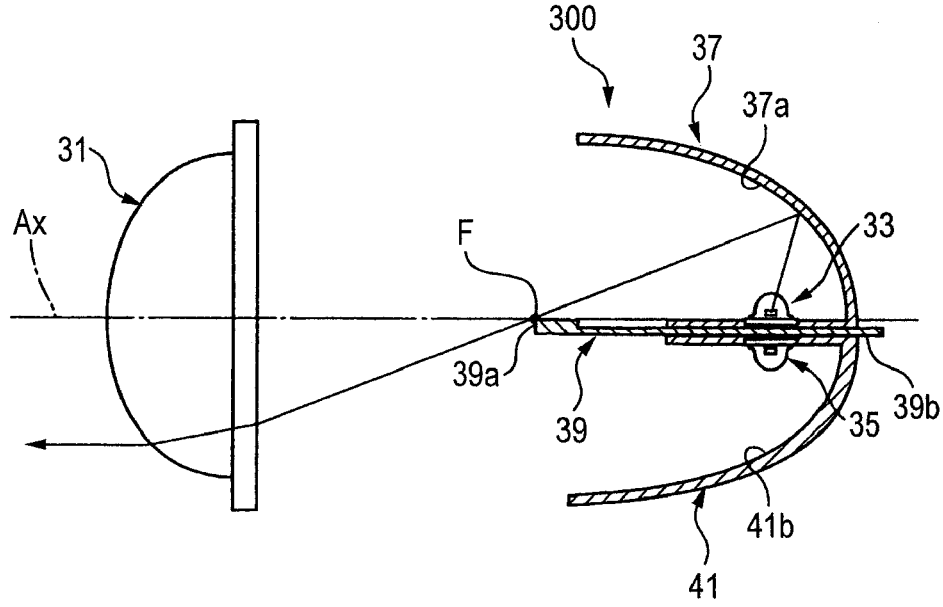
Figure 9:
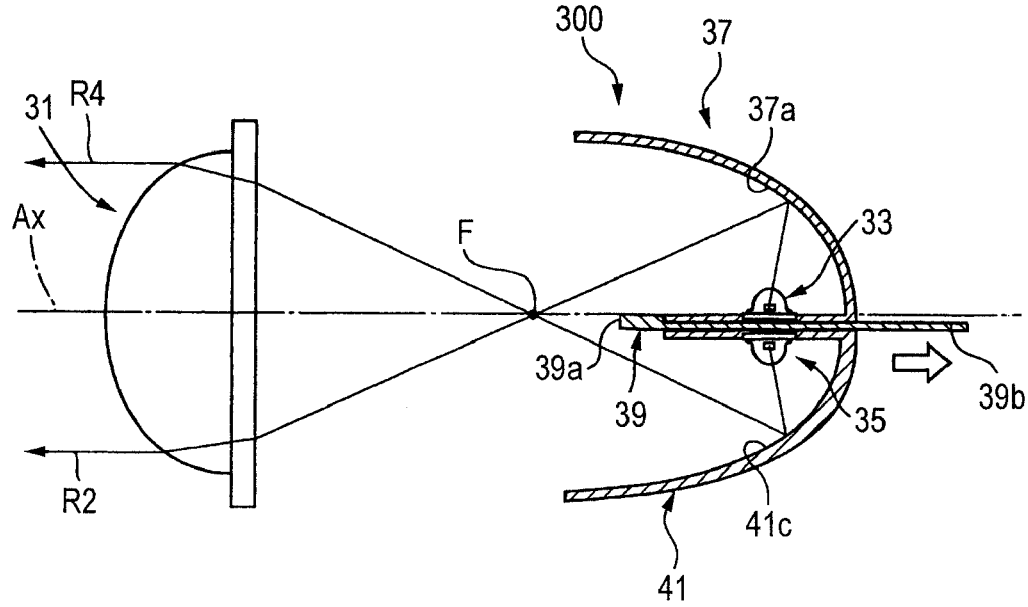

FIG. 9(*a*) is a longitudinal sectional view showing a low beam irradiation, and FIG. 9(*b*) is a longitudinal sectional view showing a high beam irradiation in the lighting unit for a vehicle according to the third exemplary embodiment of the invention in which a tip edge 39*a* of a cutoff line forming member is movable.

In the lighting unit 300 for a vehicle according to the third exemplary embodiment, as shown in FIG. 9, an LED 35 to be a second light source is provided on a lower surface side of a base portion 43.

A cutoff line forming member 39 is held movably on a tip side of the base portion 43. When a rear end 39*b* protruded from a rear end of the base portion 43 is driven by means of an actuator which is not shown, the tip edge 39*a* of the cutoff line forming member 39 is movable to a position placed apart from a projection lens 31 along an optical axis Ax extended in a longitudinal direction of the vehicle.

An additional reflector 41 is disposed on an opposite side of a reflector 37 with the base portion 43 interposed therebetween, and has a reflecting surface 41*c* formed in a substantially elliptical sphere shape having focal points on the rear focal point F of the projection lens 31 and on the LED 35.

According to the lighting unit 300 for a vehicle, therefore, when the tip edge 39*a* of the cutoff line forming member 39 is positioned on the rear focal point F of the projection lens 31 as shown in FIG. 9(*a*) (that is, in the first position), a part of a beam emitted from an LED 33 is intercepted by the tip edge 39*a*. Thus, a low beam light distribution pattern is formed.

On the other hand, when the cutoff line forming member 39 is moved rearward along the optical axis Ax extended in the longitudinal direction of the vehicle as shown in FIG. 9(*b*) (that is, in the second position), the tip edge 39*a* of the cutoff line forming member 39 is moved to a position placed apart from the rear focal point F of the projection lens 31.

In this state, a light emitted from the LED 35 is reflected by the reflecting surface 41*c* taking the shape of a substantially elliptical sphere in the additional reflector 41 so that the light is collected in the rear focal point F of the projection lens 31.

Consequently, the LED 35 is additionally turned on with the LED 33 turned on so that a high beam which does not generate an eclipse by the tip edge 39*a* of the cutoff line forming member 39 is caused to overlap with a low beam.

In the lighting unit 200 or 300 for a vehicle according to the second or third exemplary embodiment, in the case in which a light source bulb capable of obtaining a sufficient quantity of a light is used as the second light source in place of the LED 35, for example, it is also possible to turn off the first light source when turning on the second light source.

Next, description will be given to a lighting unit for a vehicle according to a fourth exemplary embodiment of the invention.

Figure 10:
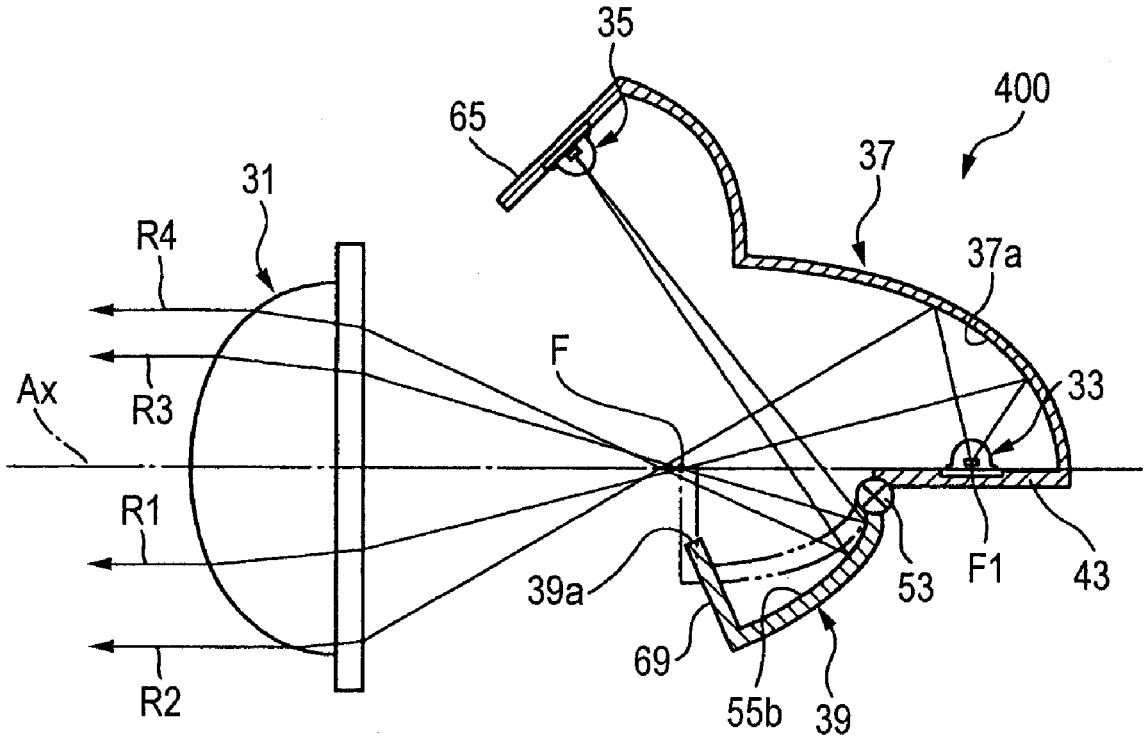
FIG. 10 is a longitudinal sectional view showing a lighting unit for a vehicle according to a fourth exemplary embodiment of the invention in which a reflecting surface taking a shape of a substantially elliptical sphere is provided on the cutoff line forming member.

FIG. 10 is a longitudinal sectional view showing a lighting unit for a vehicle according to the fourth exemplary embodiment of the invention in which a reflecting surface taking a shape of a substantially elliptical sphere is provided on a cutoff line forming member.

In a lighting unit 400 for a vehicle according to the fourth exemplary embodiment, an LED 35 is supported on a base portion 65 and a light emitted from the LED 35 is irradiated on a reflecting surface 55*b* of a cutoff line forming member 39.

The cutoff line forming member 39 includes an erected plate portion 69 having a tip edge 39*a* formed in a front part, and the reflecting surface 55*b* taking a concave shape is formed therebehind. The reflecting surface 55*b* of the cutoff line forming member 39 is formed to be a substantially elliptical sphere in which a rear focal point F of a projection lens 31 and the LED 35 are set to be focal points.

According to the lighting unit 400 for a vehicle, therefore, when the tip edge 39*a* of the cutoff line forming member 39 is moved to a position placed apart from the rear focal point F of the projection lens 31 as shown in FIG. 10 (that is, in the second position), the light emitted from the LED 35 is reflected by the reflecting surface 55*b* taking the shape of a substantially elliptical sphere in the cutoff line forming member 39 and the light is collected in the rear focal point F of the projection lens 31 and is then incident on the projection lens 31.

At the same time that the tip edge 39*a* of the cutoff line forming member 39 is separated from the rear focal point F, consequently, the light emitted from the LED 35 can be collected in the rear focal point F of the projection lens 31 by the reflecting surface 55*b* of the cutoff line forming member 39 in the separating position.

According to the structure, in the same manner as the advantages of the exemplary embodiments, a high beam which does not generate an eclipse by the tip edge 39*a* of the cutoff line forming member 39 can be caused to overlap with a low beam. In addition, the light emitted from the LED 35 can be collected in the rear focal point F of the projection lens 31 by means of one optical element (the reflecting surface 55*b* taking the shape of a substantially elliptical sphere) and can be then incident on the projection lens 31. For this reason, it is not necessary to provide other optical elements (a plane mirror and a lens). Consequently, it is possible to reduce a strength loss caused by a reflection for the light emitted from the LED 35 or a light absorption. Thus, it is possible to form a light collecting pattern in a stronger high beam.

The lighting unit for a vehicle according to the invention produces further advantages by using a lighting device for a vehicle including a plurality of units having a combination of a light collecting unit and a diffusing unit.

More specifically, in the lighting device for a vehicle including a plurality of units, the diffusing unit is changed into the light collecting unit and is thus used in some cases. By employing the lighting unit for a vehicle 100, 200, 300 or 400 as the diffusing unit, therefore, it is possible to obtain a great light collecting effect by the change into the light collecting unit.

While description has been made in connection with exemplary embodiments of the present invention, it will be obvious to those skilled in the art that various changes and modification may be made therein without departing from the present invention.

It is aimed, therefore, to cover in the appended claims all such changes and modifications falling within the true spirit and scope of the present invention.

DESCRIPTION OF THE REFERENCE NUMERALS AND SIGNS

31 . . . projection lens
33 . . . LED (first light source)
35 . . . LED (second light source)
37 . . . reflector
39 . . . cutoff line forming member
39*a* . . . tip edge
41 . . . additional reflector (a light collecting portion)
41*a*1, 41*a*2 . . . pair of reflecting surfaces taking shape of substantially elliptical sphere
55 . . . upper surface
55*a* . . . reflecting surface
57 . . . predetermined point
61 . . . step
100 . . . lighting unit for vehicle
Ax . . . optical axis
CL . . . cutoff line
F . . . rear focal point
P(H) . . . light distribution pattern for high beam
P(L) . . . light distribution pattern for low beam

What is claimed is:

1. A lighting unit for a vehicle comprising:

a projection lens disposed on an optical axis extended in a longitudinal direction of the vehicle;

a first light source disposed behind a rear focal point of the projection lens;

a second light source;

a reflector configured to forward reflect a direct light emitted from the first light source close to the optical axis;

a cutoff line forming member disposed between the projection lens and the first light source; and a light collecting portion configured to collect a light emitted from the second light source in a vicinity of the rear focal point of the projection lens, wherein a relative position of a tip edge of the cutoff line forming member and the rear focal point is changeable between a first position and a second position, wherein the tip edge is positioned in a vicinity of the rear focal point in the first position, and the tip edge of the cutoff line forming member is apart from the rear focal point in the second position, wherein, in the first position, the cutoff line forming member shields a part of a light reflected by the reflector which passes through a lower part of the rear focal point to form a cutoff line of a light distribution pattern for a low beam, and wherein, in the second position, the light emitted from the second light source is collected in the vicinity of the rear focal point to form a light distribution pattern for a high beam.

2. The lighting unit according to claim 1, further comprising a reflecting surface provided on an upper surface of the cutoff line forming member, wherein the reflecting surface of the cutoff line forming member reflects the light emitted from the second light source toward the projection lens in the second position.

3. The lighting unit according to claim 2, wherein the reflecting surface of the cutoff line forming member is formed by a plane, and wherein the light collecting portion comprises a reflecting surface formed in a substantially elliptical sphere shape having focal points on a point in a symmetrical position with the rear focal point with respect to the plane of the reflecting surface of the cutoff line forming member in the second position and on the second light source.

4. The lighting unit according to claim 2, wherein the reflecting surface of the cutoff forming member comprises a first plane and a second plane, wherein a step extending in the longitudinal direction of the vehicle is formed between the first plane and the second plane, and the cutoff line is formed by the step, wherein the light collecting portion comprises a first reflecting surface and a second reflecting surface, wherein the first reflecting surface is formed in a substantially elliptical sphere shape having focal points on a point in a symmetrical position with the rear focal point with respect to the first plane in the second position and on the second light source, and wherein the second reflecting surface is formed in a substantially elliptical sphere shape having focal points on a point in a symmetrical position with the rear focal point with respect to the second plane in the second position and on the second light source.

5. The lighting unit according to claim 2, wherein the reflecting surface of the cutoff line forming member is formed in a substantially elliptical sphere shape having focal points on the rear focal point and on the second light source.

6. The lighting unit according to claim 1, wherein the light collecting portion comprises a reflecting surface formed in a substantially elliptical sphere shape having focal points on the rear focal point of the projection lens in the second position and on the second light source.

7. The lighting unit according to claim 1, wherein the tip edge of the cutoff line forming member is capable of moving to a position placed apart from the projection lens along the optical axis.

* * * * *